US005657587A

United States Patent [19]

Gefroh

[11] Patent Number: 5,657,587

[45] Date of Patent: Aug. 19, 1997

[54] FLOATING ACCESSIBLE AREAWAY SYSTEM

[75] Inventor: James A. Gefroh, Fort Collins, Colo.

[73] Assignee: RM Base Company, Fort Collins, Colo.

[21] Appl. No.: 524,501

[22] Filed: Sep. 7, 1995

[51] Int. Cl.[6] ..... E04F 17/06

[52] U.S. Cl. ..... 52/107; 52/169.7; 52/169.6; 52/19; 52/183; 405/284

[58] Field of Search ..... 52/107, 169.7, 52/169.6, 19, 183, 184, 188; 405/284

[56] References Cited

U.S. PATENT DOCUMENTS

| | | |
|---|---|---|
| D. 262,492 | 12/1981 | Mackes . |
| D. 275,894 | 10/1984 | Sihorski . |
| 300,654 | 6/1884 | Smith . |
| 984,942 | 2/1911 | Leddy . |
| 1,108,613 | 8/1914 | Parker . |
| 1,257,221 | 2/1918 | Grossman . |
| 1,695,810 | 12/1928 | Magill . |
| 1,803,091 | 4/1931 | Bernis . |
| 1,840,397 | 1/1932 | Keyes . |
| 1,916,202 | 7/1933 | Bubien . |
| 2,162,628 | 6/1939 | Martin . |
| 2,237,564 | 4/1941 | Keyes . |
| 2,308,131 | 1/1943 | Wellnitz . |
| 2,316,712 | 4/1943 | Prince et al. . |
| 2,453,609 | 11/1948 | Whitehouse . |
| 2,695,689 | 11/1954 | Peterson . |
| 2,761,180 | 9/1956 | Krelwitz . |
| 2,936,504 | 5/1960 | Harris . |
| 3,004,634 | 10/1961 | Evans et al. . |
| 3,173,387 | 3/1965 | Cree, Jr. . |
| 3,232,014 | 2/1966 | Frost . |
| 3,344,886 | 10/1967 | Boscarino, Jr. . |
| 3,470,664 | 10/1969 | Whitehead . |
| 3,608,252 | 9/1971 | Bisson . |
| 3,634,991 | 1/1972 | Barton, Jr. . |
| 3,646,707 | 3/1972 | Lystad . |
| 3,738,070 | 6/1973 | Yarbrough . |
| 3,738,074 | 6/1973 | Tucker . |
| 3,762,501 | 10/1973 | Probets . |
| 3,835,586 | 9/1974 | Gates et al. . |
| 3,844,076 | 10/1974 | Schlick . |
| 3,848,378 | 11/1974 | Witte . |
| 3,890,742 | 6/1975 | Ladd et al. . |
| 3,893,541 | 7/1975 | Servais . |
| 3,897,653 | 8/1975 | Hayden et al. . |

(List continued on next page.)

FOREIGN PATENT DOCUMENTS 2318702 10/1974 Germany .

OTHER PUBLICATIONS

Uniform Building Code 1985 Edition, Published in 1985. Chapter 12 pp. 71–73 and Appendix p. 743, and Chapter 33, pp. 554–565.

National Fire Protection Association Life Safety Code Handbook, Chapter 22, pp. 945–958 and Chapter 30, pp. 1133–1137.

Scientific American, Nov. 27, 1886, p. 344.

*Primary Examiner*—Wynn E. Wood

*Attorney, Agent, or Firm*—Luke Santangelo

[57] ABSTRACT

A floating areaway system which can respond to changing soils conditions (such as freezing, expansion, settling, or the like) utilizes a continuously adjustable attachment to the foundation or a free motion support. The system is particularly adapted to overhanging areaway enclosures such as may include an escape dement. The designs can range from slidable retainers to elastic members to rotating elements so that the areaway enclosure can move up or down with the soil. Shields, low friction surfaces, and waterproof elements can be included to assure continuous operation. Installation, whether new or retrofit, is facilitated through individual free motion support brackets which can accommodate previously installed areaway enclosures as well as a new enclosure. The brackets can be designed to be specific to particular designs, generic, removable, and reversible so that the mounting can be in either the interior or the exterior of the enclosure. Integral designs afford efficient manufacture and installation.

103 Claims, 4 Drawing Sheets

U.S. PATENT DOCUMENTS 3,974,599 8/1976 Grosh .
3,981,110 9/1976 Le Carnoc .
3,999,334 12/1976 Webb .
3,999,335 12/1976 Nagy et al. .
4,127,184 11/1978 Strohmeyer .
4,222,458 9/1980 Pratt .
4,226,062 10/1980 Doane .
4,303,178 12/1981 Ford, Jr. .
4,307,768 12/1981 Anderson .
4,330,500 5/1982 Mackes .
4,383,592 5/1983 Hoffa .
4,469,193 9/1984 Rumsey, Jr. .
4,495,728 1/1985 Lynn .
4,531,612 7/1985 Sandor .
4,555,867 12/1985 Stibolt .
4,663,885 5/1987 Stibolt .
4,704,828 11/1987 Kemp .
4,725,170 2/1988 Davis .
4,728,227 3/1988 Wilson et al. ..... 405/284
4,768,307 9/1988 Holowecky .
4,799,348 1/1989 Brami et al. .
4,820,020 4/1989 Terrill .
4,831,793 5/1989 Galloway et al. .
4,856,939 8/1989 Hilfiker .
4,867,275 9/1989 Islava et al. .
4,873,802 10/1989 Dahowski .
4,876,833 10/1989 Gefroh et al. .
4,896,467 1/1990 McGinnis .
4,899,646 2/1990 Maras .
4,903,455 2/1990 Veazey .
4,929,125 5/1990 Hilfiker .
4,936,713 6/1990 Miner .
4,970,827 11/1990 Djordjevic .
4,993,879 2/1991 Hilfiker .
5,028,172 7/1991 Wilson .
5,030,035 7/1991 Babcock .
5,044,833 9/1991 Hilfiker .
5,107,640 4/1992 Gefroh .
5,131,791 7/1992 Kitziller .
5,145,285 9/1992 Fox et al. .
5,163,261 11/1992 O'Neill .
5,249,769 10/1993 Grick et al. .
5,261,350 11/1993 Vavrek .
5,271,195 12/1993 Wahe .
5,339,579 8/1994 Woodyer et al. .

FLOATING ACCESSIBLE AREAWAY SYSTEM

BACKGROUND OF THE INVENTION

This invention generally relates to the field of areaways, that is, enclosures for basement windows and the like. Specifically, the invention involves escapable areaway systems and concerns improvements which ease installation and can permit the areaway to float with expansion or contraction of the adjacent soil.

For more than a century, the technique of admitting light through a basement window has existed. This can make the space more desirable and can meet other requirements. To admit the light, an areaway enclosure is often used, that is a structure that acts to hold the earth away from the window or door so that light can be admitted. In spite of the fact that areaways have existed for a long period of time, in the late 1980's a number of advances were made which greatly improved desirability and safety. These changes resulted in, not only improving the structure itself, but also its function such that escape and egress were accommodated. These improvements, detailed in U.S. Pat. Nos. 4,876,833 and 5,107,640 (hereby incorporated by reference), were so easily accepted that some states have made such egress designs mandatory through uniform building code changes and the like.

In utilizing these improved areaways as well as others, it has become obvious that typical areaway design, that it is a design that is generally fixed to the foundation face of the building, has not always been entirely acceptable. A number of problems have become evident ranging from the challenges of backfilling the areaway structure after construction to the attachment of the areaway structure itself to dealing with expansion, contraction or settling of the soil surrounding the areaway. As a result of these challenges, there has developed a need not only to facilitate installation but also to more appropriately accommodate both the construction nuances and the actual character of the soil typically surrounding such a structure. Perhaps surprisingly, although the field of areaway structures might be considered mature in some regards, prior to the present invention, the needs both during installation and in actual use have not been entirely met.

The present invention shows that with available arts and elements such needs can be easily met through proper design. The fact that others have not, until the present invention, solved these problems may be the result of two general tendencies. First, many areaway structures were not designed to facilitate egress. As a result those types of structures may have actually had vertical boundaries where settling or expansion and contraction of the soil did not present a particularly acute problem. A second tendency is that of the preconceptions of those skilled in the art. In instances where soil settling or expansion and contraction were of concern, prior to the present invention those skilled in the art seemed to accept such problems and not consider that a solution might be possible through proper design of the areaway system itself. The present invention shows that in fact proper design can greatly facilitate not only installation of an areaway structure but also its actual function.

SUMMARY OF THE INVENTION

Accordingly, the present invention provides an areaway system which has a continuously adjustable attachment element. This attachment element may allow free motion of the areaway so that it can float and actually move as soil conditions dictate. The invention also allows a design which can include an escape element and which is efficient to both manufacture and install. A modular and component-based system is disclosed. This can permit easy changes in configuration for both new and retrofit installations.

One of the objects of the inventions is thus to enhance the ease of the initial installation of the areaway structure. In keeping with this objective a goal is to avoid the challenge of specific and precise ground alignment and to even allow adjustment of the areaway level after it has been installed. Another goal is to provide a system which can be either preconfigured or configured by the user to accommodate existing window bucks and foundations. In keeping with this goal, it is desired to provide a reversible system which can be configured as desired for both installation and aesthetic reasons.

Another object of the invention is to allow the areaway to move with the ground surrounding it. Thus is it a goal for the areaway to accommodate expansion and contraction of soil conditions, to accommodate settling (as might be incidental to a new construction), and to accommodate sort conditions where there might be freezing and thawing of the soil throughout the course of the year. It is also a goal for such an areaway design to allow for movement that is not restricted when freezing occurs and thus some designs have as a goal keeping the movement features free and unencumbered throughout the years.

Yet another object of the invention is to provide a design which easily accommodates escape system improvements. As mentioned such improvements are becoming increasingly required by code changes and the like. Thus a goal for the invention is to provide a system which is particularly designed for escapable areaways. It is also a goal to present a design which may be utilized in larger areaways.

A further object of the invention is to provide a design which can easily be retrofit to existing areaways. In instances where the newer code changes are desired to be complied with, the entire areaway structure might be replaced with one having an escape feature. Accordingly, it is a goal to provide a design where such retrofit desires are accommodated. Generally the designs are such that homeowners may easily replace such structures by themselves. In instances where the old areaway is still desired to be used, it is also a goal to provide for designs which can be easily reconfigured so that they may be utilized with the existing areaway structure.

Another practical object of the invention is for the design to be very economical to manufacture. The design thus presents a number of integral features which allow for an efficient and inexpensive design.

Naturally further objects of the invention are disclosed throughout other areas of the specification and claims.

DETAILED DESCRIPTION OF THE PREFERRED EMBODIMENTS

Figure 1:
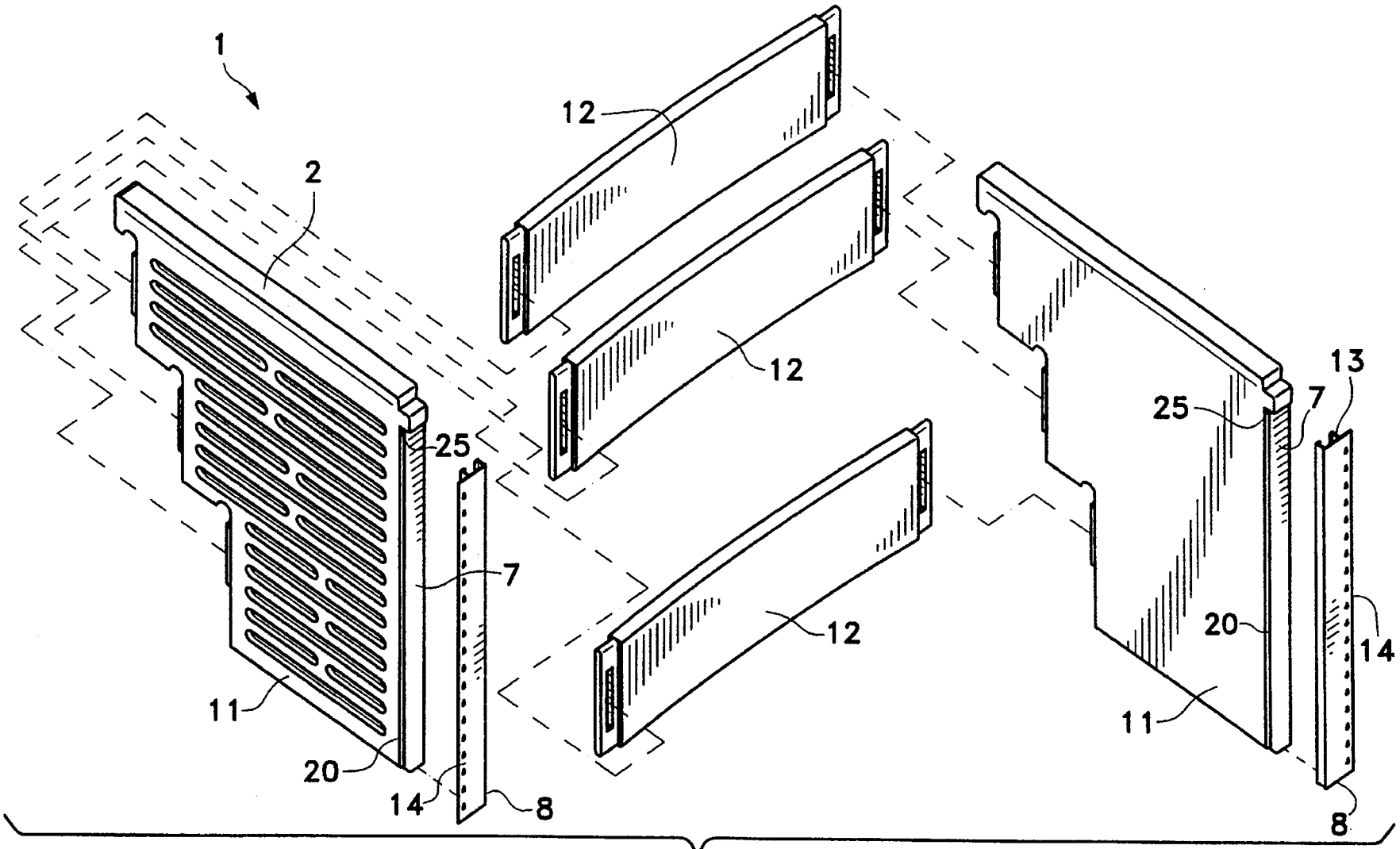
FIG. 1 is an exploded perspective view of one areaway design according to the present invention.
Figure 2:
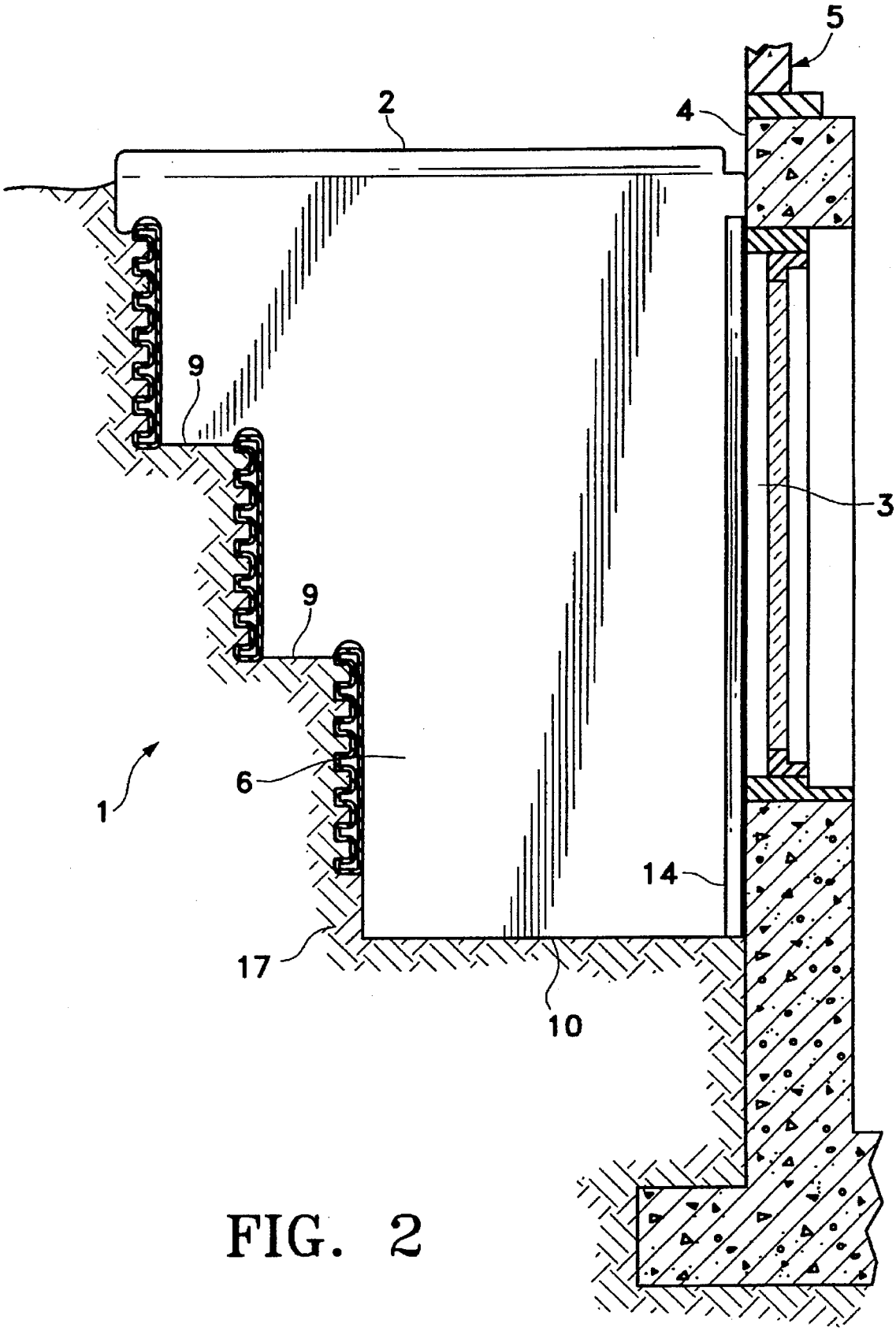
FIG. 2 is a side cross sectional view of an installed design such as shown in FIG. 1.

As can be seen from the drawings, the basic concepts of the present invention may be embodied in many different ways. FIG. 1 shows the areaway system (1) in an exploded view. FIG. 2 shows the same areaway system assembled and installed in a cross-sectional view. As can be understood from these figures, the areaway system (1) has a top edge (2) which is designed to be open to allow light and/or egress through a window opening (3). The window opening (3) may actually be some type of cutout in foundation face (4) of a building (5). As can be understood, the areaway enclosure (6) will be situated below the top edge (2) and may abut the foundation face (4) along at least two foundation face edges (7).

As shown in the figures, this particular design has two side mounts (8) which allow for attachment of the areaway enclosure (6) to the foundation face (4). As those involved in this field readily understand the side mounts (8) may present one type of a great variety of means for detachably connecting some type of structure to the foundation face (4) wall. Thus, it should be understood that while a great variety of designs are possible only one may be shown. This should not be interpreted as limiting the scope of this patent. It is intended and does encompass all varieties of possible attachment designs; all that is necessary is that the attachment somehow restrict the areaway enclosure (6) with respect to the foundation face (4). Thus, the two side mounts (8) present just one type of areaway attachment and one means which acts to attach. In keeping with this general concept it should also be understood that while the areaway enclosure (6) is shown as some type of enclosure, a great variety of other types of enclosures are also possible. Such enclosures may or may not include an escape element such as the steps (9) shown. Additionally, it should be understood that the areaway enclosure (6) need not be strictly mounted to a foundation portion of the building (5). While, naturally, foundation mounting is the primary type of mounting and a particular mounting which the designs shown are intended to accommodate, other types or locations of mounting are also possible.

As shown in FIG. 2 it can be seen that the areaway enclosure (6) may also be designed to accommodate some type of drain (10), also referred to as a means for draining. As shown in FIG. 2, the drain (10) is an exposed opening at the bottom of the areaway enclosure (6). This opening may merely be a natural drain as shown. This is equivalently referred to as a means for accessing the earth. It may also be an aesthetic feature such as some type of means for planting, may be a formal drain design, or may merely be an unsealed bottom portion.

From FIG. 1 it can be understood that the areaway enclosure (6) may be modular. As shown, the design may utilize side elements (11) which might be designed to be attached in some fashion to step faces (12). The elements of any design may be manufactured in a variety of ways from virtually any material although at present a blow molded plastic design is preferred. As those skilled in the art could easily understand, the element(s) may also be simply molded, milled, stamped, hollow, solid, or the like. As shown, a modular design may be assembled by some generic type of means for affirmatively retaining the step faces (12) to the side elements (11) or by the specific mating system shown. Through such a design the areaway enclosure (6) may easily accommodate being disassembled for shipment. As is known, such designs may also be configured so as to allow nesting for shipment and retailing. Importantly, the designs shown can provide some type of continuously adjustable attachment. As shown in FIGS. 1 and 2 this continuously adjustable attachment may be a pair of slidable retainers (13) which provide for a number of features. First, by being continuously adjustable they allow the exact positioning of the areaway enclosure (6) with respect to the foundation face (4). This allows the areaway to be positioned at any level even after it has been attached to the foundation face (4). Second, by being positioned vertically, the continuously adjustable attachments, such as the slidable retainers (13) shown, can allow for vertical movement. This is particularly important because most settling and changes to the soil are of concern in the vertical direction. It also allows for back filling to occur and then for the areaway to be positioned on top at the desired fill level. As can be understood these attachments may be positioned as shown between the areaway enclosure (6) and the building (5).

As shown in the figures, the areaway enclosure (6) may be attached to the foundation face (4) through some sort of foundation face attachment (14). This element could be a portion of a continuously adjustable attachment which is designed to mate with some portion of the building (5). As shown in FIG. 1, the foundation face attachment may consist of numerous holes so that a variety of mounting locations can be selected as appropriate for that particular installation. Importantly it should be noted that through the use of the term foundation face attachment, it is not intended that such attachment portion be limited to only a portion which mounts directly to the foundation. As those skilled in the art could easily understand, the foundation face attachment (14) can be configured to mate with a window buck or some other portion of the building (5) as well.

It can also be understood that the areaway enclosure (6) can be responsive to the foundation face attachment (14). This can be accomplished by mounting the foundation face attachment (14) to the areaway enclosure so as to hold the areaway enclosure (6) in at least one direction. In the embodiments shown, it can be appreciated that the attachment restricts the movement of the areaway enclosure (6) so that it has only one degree of freedom—vertical motion. Through the slide elements discussed later the areaway enclosure (6) can move up or down while simultaneously being retained in other directions. This may include designing the foundation face attachment (14) so that it both laterally and orthogonally retains the areaway enclosure (6).

Figure 3:
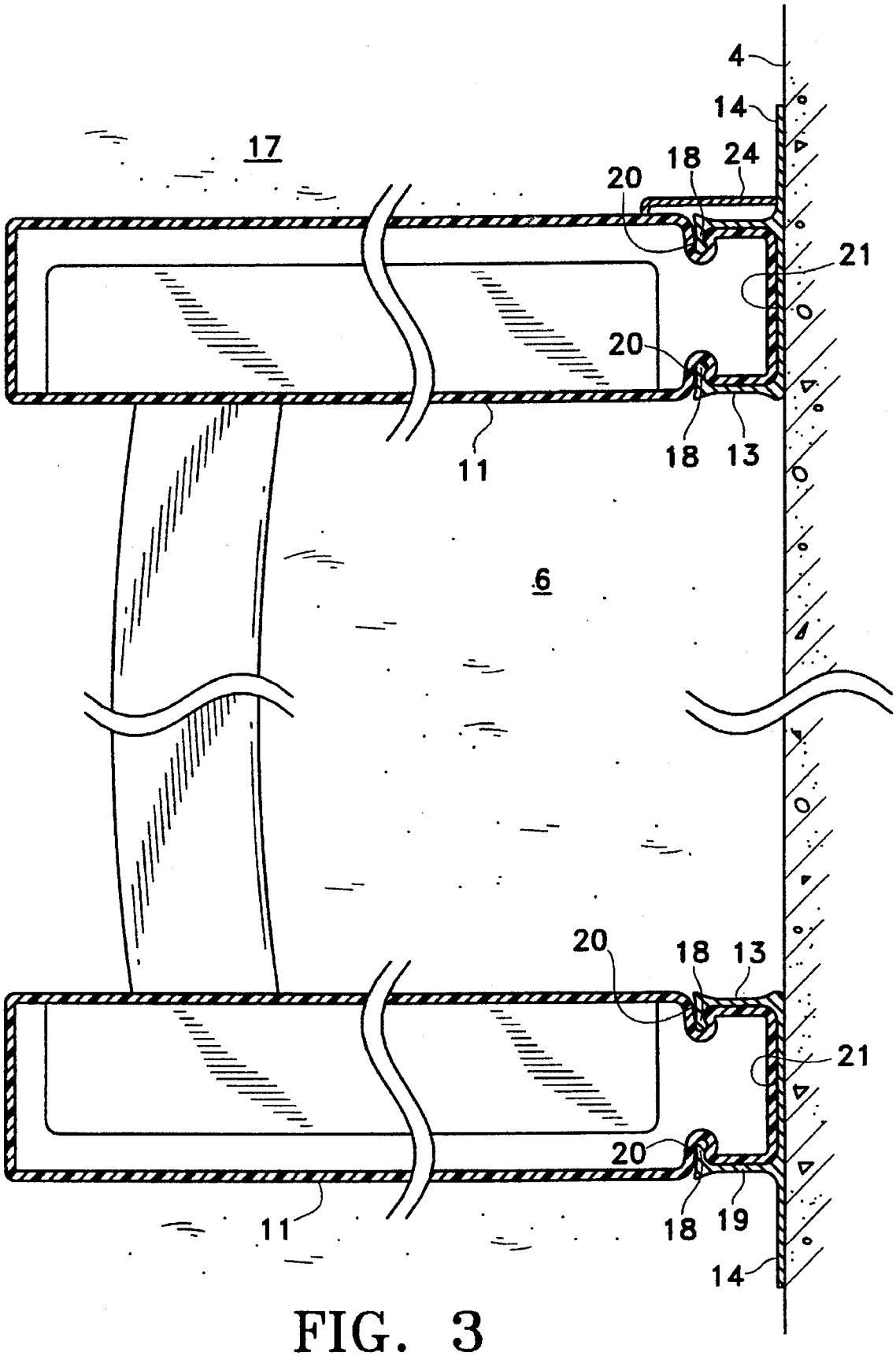
FIG. 3 is a cross-sectional top view through one of the slide designs shown in FIGS. 1 and 2 with one side showing the addition of a shield arrangement.

As shown in FIG. 3, the slidable retainers (13) may form tracks (21) and may not permit the side elements (11) to move sideways with respect to the foundation face (4). Similarly, by including lips (18) which engage the side elements (11) in slots (20), the areaway enclosure (6) can be orthogonally retained against the foundation face (4) so that the areaway enclosure (6) cannot pull away from the foundation face (4). Thus, the design can provide both a lateral retainer and an orthogonal retainer to which the areaway enclosure (6) is responsive and which in turn is responsive to the foundation face attachment (14).

One feature of the design which is important commercially is that the product be efficient to manufacture. In this regard the design shown includes a number of integral features. As shown in FIG. 1, the areaway enclosure (6), or in this case more specifically the side element (1 1) may have designed into it an integral side mount such as the slots (20). This integral side mount may be designed so as to mate in some coordinated fashion with an integral mount such as lips (18). Lips (18) may be part of the continuously adjustable vertical element, in this case, the slidable retainer (13). By making all such elements integral, namely one portion of a unitary formed element, the designs can be more efficiently manufactured and can be priced more favorably. Again, as those skilled in the art could easily understand, any manufacture of a foundation face attachment this can be accomplished using a variety of manufacturing techniques ranging from molding to willing to extruding and the like. Similarly, the element can also be manufactured from virtually any material although at present aluminum is preferred.

As mentioned earlier, the continuously adjustable vertical element facilitates installation of the areaway enclosure (6). In some designs it might be possible to loosely attach the enclosure, adjust the height and then tighten the attachment to hold it firmly in place. The areaway enclosure (6) might also be permitted to float or move freely in at least one direction after it has been installed. This floating or free movement is accomplished in the design shown through the use of the slidable retainer (13) which acts as some type of free motion support.

As a free motion support, this design can act to support the areaway enclosure (6) so that it is restricted in at least one direction. The free motion support is also some type of element which permits the areaway enclosure (6) to move freely in at least one direction. In the design shown, the slidable retainer (13) acts as a free motion support by restricting the areaway enclosure (6) both laterally and orthogonally while simultaneously permitting it to move freely in a vertical direction. As mentioned earlier, this free motion support can also be designed to have an integral mount. Obviously, the slidable retainer (13) may be made from separate components, as well. It may also be designed to allow free motion in other directions including lateral and even orthogonal directions depending upon the application desired. As should be generally understood, while one type of free motion support is shown, certainly there are a host of other designs possible ranging from baffles to bellows to even overlapping elements. The important features are merely that the designs selected permit motion to the degree desired. While it is presently believed that vertical motion will be desired in most applications, other directions and numbers of directions of free motion are also possible and would still fall within the scope of this patent. The motion also may or may not be linear. While a slide design seems efficient and does present vertically linear motion, other designs might permit arcuate or some other direction or path of motion and still fall within the scope of this patent.

As mentioned earlier one of the problems which the present invention is designed to address is motion of the ground surrounding the areaway enclosure (6). Through its design, the embodiment is configured to be responsive to ground motion at least in the vertical direction. By situating the areaway enclosure (6) adjacent to the ground (17), the areaway enclosure (6) actually moves responsive to the ground and will maintain its position adjacent to it. Thus, if the ground were to settle, expand through the addition of moisture, or expand through freezing the areaway enclosure (6) would react appropriately.

In instances such as where the ground might become frozen and the like it may also be important to assure that the free motion support to remain free. This can be accomplished by using particular movement surfaces such as some nonporous surfaces, by using particular materials such as an anti-icing surface (Teflon, silicone or the like), or by even using some type of shield arrangement so that moisture cannot significantly impair the motion of the areaway enclosure (6) relative to the foundation face (4).

As shown on one side of the alternative design in FIG. 3, the unit may also include some type of shield (24). This can be an integral or separately affixed component which may act to protect the free motion support from the ground (17). Naturally, this shield (24) might be incorporated in any other design and might be utilized to protect not only an element such as the slidable retainer (13) but other elements such as the wheels (26) shown in FIG. 4. This shield (24) might be designed to be either flexible or waterproof or both so that the motion can continue unencumbered throughout the course of use. In instances in which the appropriate surface is selected so that water will not tend to encumber the motion of the areaway enclosure (6), the shield (24) might only limit the movement of dirt to sensitive areas. The shield (24) might be designed to be integral to the free motion support as well.

As also shown in the figures, it can be seen that the areaway enclosure (6) may be designed to incorporate some type of means for escaping, literally any escape element. In the design shown this escape element consists of a variety of steps (9). Naturally, other elements are possible as shown in some of the patents referenced earlier. This invention, however, has particular value in applications involving steps because there is some element of overhang on the areaway enclosure (6) making it more potentially important for the areaway enclosure (6) to constantly reposition itself adjacent to the ground (17).

As mentioned, FIG. 3 shows a top cross-sectional view of a sliding free motion support. As can be seen the slidable retainer (13) includes an integral mount for the foundation face attachment (14). The design also shows the lips (18) at the end of the guides (19). Since these guides (19) act to retain the areaway enclosure (6) laterally, the areaway enclosure (6) is responsive to the free motion support. In order to retain the areaway enclosure (6) orthogonally, the guides (19) may have lips (18). These lips (18) may be coordinated to fit within the slots (20) and may form tracks (21) as shown. Most areaway enclosures are designed to abut a foundation face (4) along a left and a right side, namely at two vertical foundation face edges (7). By providing at least two tracks (21) and at least two guides (19), one guide and one track can be provided for each side of the enclosure. Through this design it can be seen that the slidable retainer (13) actually forms a track (21) for each side within which the areaway enclosure (6) may be positioned and to which it may be responsive.

Figure 4:
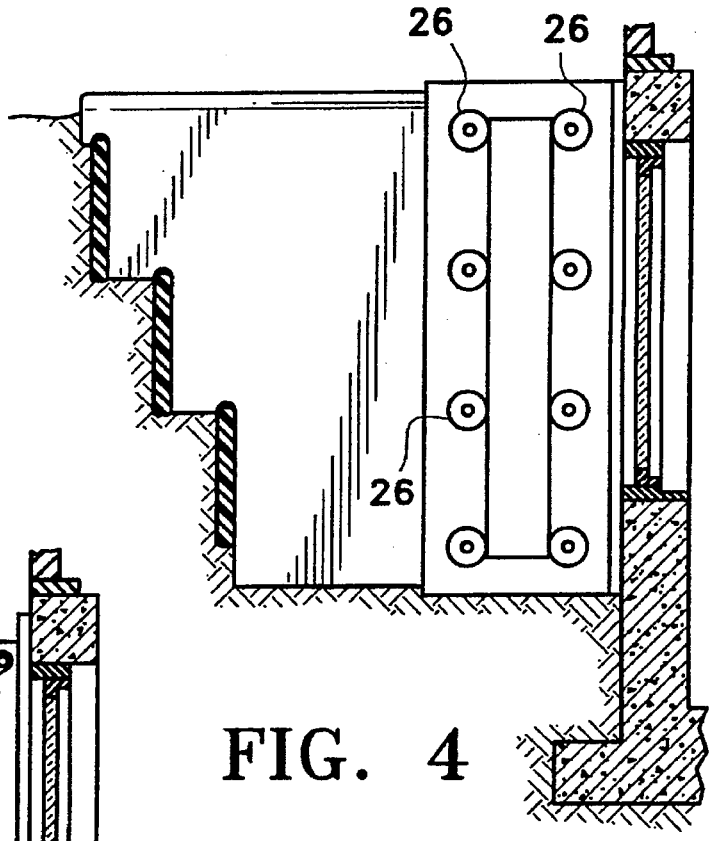
FIG. 4 is a schematic illustration of a wheel-based free moving element design.

As mentioned earlier there are a variety of alternative designs possible for both the continuously adjustable attachment and the free motion support. As shown in FIG. 4, the free motion support may include some type of rotating element. This is shown as the inclusion of wheels (26). These wheels may include some type of bearing through which friction can be minimized. In this design the motion of the areaway enclosure (6) is accomplished by rotating some type of element. Naturally, as those skilled in the art would easily understand a variety of other rotating designs are also possible including such rotating elements as ball beatings and the like.

Figure 5:
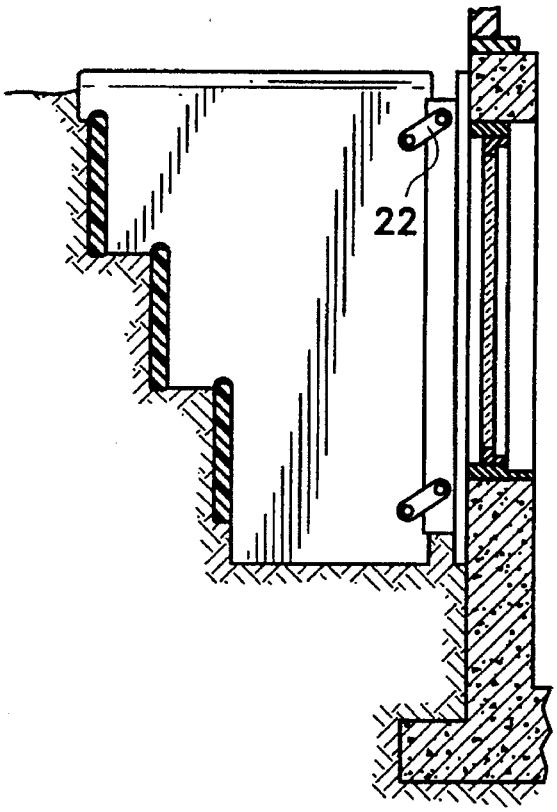
FIG. 5 is a schematic illustration of a pivoting free movement design.
Figure 6:
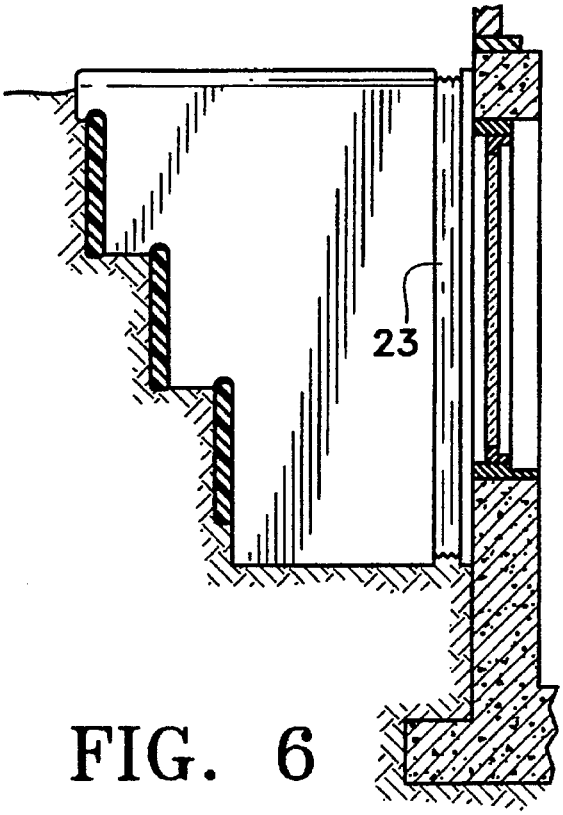
FIG. 6 is a schematic illustration of a flexible free movement design.

Yet another type of design is shown in FIG. 5. This shows a pivoting design where the attachment includes at least one pivot (22). This might be a rigid arm which is attached to rotate about some point or it might even be some type of flexible or even an elastic element through which pivoting is possible. Similarly, some type of flexible element (23) might be included as shown in FIG. 6.

In any design it might be desirable to in corporate some type of movement stop (25). This is shown in FIGS. 1 and 2 as merely the end of the slot (20). The stop (25) has the effect of limiting the movement of the free moving support or continuously adjustable support with respect to the areaway enclosure (6). This can be important when there is free vertical movement and can also be important during installation. As shown it can be seen that the stop (25) can act to restrict downward motion. Thus, during installation, the areaway can be attached without sliding down too low. It then can be raised and the ground filled in beneath it and lowered until it contacts the ground. While naturally the stop might act in any direction (or both directions) limiting movement in only one direction has an advantage during installation in that the supports can be attached and then the areaway slid into the direct position. It may then be adjusted with respect to the foundation by the mount of ground placed below the areaway enclosure (6).

In keeping with the goal of providing a design which is efficiently manufactured, it is possible that the stop (25) be an integral tab of some sort or other. This integral tab might be positioned on either the areaway enclosure (6) (as shown) or adjacent one end of the free motion support. In designs where there are at least two lips on the free motion support, as shown in the figures, it is possible to have the integral tab adjacent these lips when assembled.

An efficient design should also accommodate varying installation needs. In the embodiments shown this is accomplished by providing a design which is reversible. As shown in FIGS. 1, 2 and 3, it can be understood that the free motion supports shown as the slidable retainers (13) can be reversed so that they may attach either on the inside of the areaway enclosure (6) or on the outside of the areaway enclosure (6). This can be simply accomplished by removing the slidable retainers (13) and then placing them on different sides of the areaway. As shown, the slidable retainers (13) can be configured so as to have axially opposite configurations. Through this design, each can face an opposite direction about the vertical axis (the axis along which vertical movement takes place after installation). During installation the user may select the desired orientation, position the continuously moveable attachments adjacent to the foundation opening and then retain the areaway to the foundation opening. Thus the slidable retainers (13) can serve as two removable elements. These elements might even be axially symmetric as well as axially opposite such as in instances where the mounting holes might be merely circles rather than the keyhole-shaped holes presently preferred.

In applications where different types of foundation face attachments (14) are desired, it may even be possible to completely replace the slidable retainers (13) with ones which have been specifically manufactured for that particular application. Thus, if there were different window bucks or other types of locations where it was deskable to attach the areaway enclosure to the foundation face, different attachments could be purchased. As shown in FIG. 1, the slidable retainers (13) include a variety of holes. These holes may be adjustable by sliding the slidable retainers (13). They also might have a number of holes placed on them so that any number of holes might be selected. This can greatly aid in accommodating a less precise installation effort. To achieve installation, the continuously moveable attachments may either be attached to the foundation face first or attached to the areaway enclosure (6) first and then attached to the foundation face.

Another important aspect of the invention is it features which allow easy retrofitting to existing foundations. This can be accomplished by locating the foundation opening and then removing the old areaway enclosure and either replacing the same enclosure utilizing the free motion supports of this invention or entirely replacing the areaway enclosure with a more deskable one. By utilizing the free motion supports of this invention the owner can thus establish an ability for continuous movement either during installation or free movement during use of the areaway to accommodate the soil conditions as mentioned earlier. As those skilled in the art would easily understand the design may be configured to accommodate standard attachments for areaway enclosures and thus minimize reinstallation effort. As mentioned earlier the reinstallation can either involve installing the free motion support against the foundation and then attaching the areaway enclosure (6) to that free motion support or installing the free motion support to the areaway enclosure (6) and then installing the combined unit on the foundation face. Similarly, other designs can be provided where a portion of the free motion support is installed to the foundation and that portion is installed to the areaway enclosure (6). These two portions can then be joined either by sliding or some other attachment technique.

The foregoing discussion and the claims which follow describe the preferred embodiments of the present invention. Particularly with respect to the claims, it should be understood that changes may be made without departing from the essence of the invention. In this regard, it is intended that such changes would still fall within the breadth of protection encompassed by this patent. It simply is not practical to describe and claim all possible revisions to the present invention which may be accomplished. This is particularly true for the present invention since it involves basic concepts and understandings which are fundamental in nature and can be broadly applied.

I claim:

1. An areaway system for a building comprising:

a. a top edge;

b. an areaway enclosure situated below said top edge and having at least two foundation face edges;

c. at least two side mounts adjacent said foundation face edges; and d. a continuously adjustable attachment situated between said areaway enclosure and a building.

2. An areaway system for a building as described in claim 1 wherein said continuously adjustable attachment comprises a free motion support.

3. An areaway system for a building as described in claim 2 wherein said continuously adjustable attachment comprises a free motion support which is responsive to ground motion.

4. An areaway system for a building as described in claim 2 wherein said free motion support permits vertical movement.

5. An areaway system for a building as described in claim 4 wherein said free motion support restricts the free motion of said areaway enclosure to one degree of free motion.

6. An areaway system for a building as described in claim 1 or 2 wherein said continuously adjustable attachment comprises a slidable retainer.

7. An areaway system for a building as described in claim 6 and further comprising a low friction surface to which said areaway enclosure and said slidable retainer are responsive.

8. An areaway system for a building as described in claim 1 or 2 wherein said areaway enclosure comprises a positive escape element.

9. An areaway system for a building as described in claim 6 wherein said areaway enclosure comprises a positive escape element.

10. An areaway system for a building as described in claim 6 wherein said slidable retainer comprises:

a. at least two guides to which said areaway enclosure is responsive; and b. at least two tracks to which said guides are responsive.

11. An areaway system for a building as described in claim 10 wherein said guides are integral to said areaway enclosure.

12. An areaway system for a building as described in claim 4 wherein said free motion support comprises at least two removable elements.

13. An areaway system for a building as described in claim 12 wherein said removable elements are reversible.

14. An areaway system for a building as described in claim 6 wherein said slidable retainer comprises at least two removable elements which have axially opposite configurations.

15. An areaway system for a building as described in claim 2 and further comprising a movement stop to which said free motion support is responsive.

16. An areaway system for a building as described in claim 15 wherein said stop restricts downward motion.

17. An areaway system for a building as described in claim 15 wherein each of said free motion support comprises:

a. at least two lips situated near and parallel to at least two of said foundation face edges of said areaway enclosure; and b. at least two slots parallel to said lips and to which said areaway enclosure has a fixed relationship.

18. An areaway system for a building as described in claim 16 wherein said movement stop comprises an integral tab adjacent one end of said free motion support.

19. An areaway system for a building as described in claim 6 wherein said slidable retainer comprises a flexible surface.

20. An areaway system for a building as described in claim 10 wherein each of said guide comprises at least one flexible surface.

21. An areaway system for a building as described in claim 2 wherein said free motion support comprises at least one rotating element.

22. An areaway system for a building as described in claim 21 wherein said rotating element comprises a wheel.

23. An areaway system for a building as described in claim 21 wherein said rotating element comprises a bearing.

24. An areaway system for a building as described in claim 2 wherein said free motion support comprises at least one pivot.

25. An areaway system for a building as described in claim 2 and further comprising a low friction surface to which said free motion support is responsive.

26. An areaway system for a building as described in claim 2 wherein said free motion support comprises at least one flexible element.

27. An areaway system for a building as described in claim 2 and further comprising a shield which protects said free motion support.

28. An areaway system for a building as described in claim 6 and further comprising a shield which protects said slidable retainer.

29. An areaway system for a building as described in claim 28 wherein said shield is integral.

30. An areaway system for i building as described in claim 28 wherein said shield is flexible.

31. An areaway system for a building as described in claim 28 wherein said shield is substantially waterproof.

32. An areaway system for a building as described in claim 21, 24, or 25 and further comprising a shield which protects said slidable retainer.

33. An areaway system for a building as described in claim 32 wherein said shield is integral.

34. An areaway system for a building as described in claim 32 wherein said shield is flexible.

35. An areaway system for a building as described in claim 32 wherein said shield is substantially waterproof.

36. An areaway system for a building as described in claim 34 wherein said shield is substantially waterproof.

37. An areaway attachment system to hold an areaway to a building comprising:

a. a foundation face attachment;

b. a lateral retainer responsive to said foundation face attachment;

c. an orthogonal retainer responsive to said foundation face attachment; and d. a continuously adjustable vertical element responsive to said foundation face attachment.

38. An areaway attachment system to hold an areaway to a building as described in claim 37 wherein said continuously adjustable vertical element comprises a free motion support.

39. An areaway attachment system to hold an areaway to a building as described in claim 38 wherein said continuously adjustable vertical element comprises a slidable retainer.

40. An areaway attachment system to hold an areaway to a building as described in claim 37 wherein said continuously adjustable vertical element comprises an integral mount.

41. An areaway attachment system to hold an areaway to a building as described in claim 39 wherein said slidable retainer comprises:

a. at least two guides; and b. at least two tracks to which said guides are responsive.

42. An areaway system for a building as described in claim 38 wherein said vertical element comprises at least two removable elements.

43. An areaway system for a building as described in claim 42 wherein said removable elements are reversible.

44. An areaway system for a building as described in claim 39 wherein said slidable retainer comprises at least two removable elements which have axially opposite configurations.

45. An areaway attachment system to hold an areaway to a building as described in claim 38 and further comprising a movement stop to which said free motion support is responsive.

46. An areaway attachment system to hold an areaway to a building as described in claim 45 wherein said movement stop restricts downward motion.

47. An areaway attachment system to hold an areaway to a building as described in claim 45 wherein said free motion support comprises:

a. at least two lips; and b. at least two slots parallel to said lips.

48. An areaway attachment system to hold an areaway to a building as described in claim 46 wherein said movement stop comprises an integral tab adjacent one end of said free motion support.

49. An areaway attachment system to hold an areaway to a building as described in claim 39 wherein said slidable retainer comprises a flexible surface.

50. An areaway attachment system to hold an areaway to a building as described in claim 41 wherein each of said guides comprises at least one flexible surface.

51. An areaway attachment system to hold an areaway to a building as described in claim 38 wherein said free motion support comprises at least one rotating element.

52. An areaway attachment system to hold an areaway to a building as described in claim 51 wherein said rotating element comprises a wheel.

53. An areaway attachment system to hold an areaway to a building as described in claim 51 wherein said rotating element comprises a bearing.

54. An areaway attachment system to hold an areaway to a building as described in claim 38 wherein said free motion support comprises at least one pivot.

55. An areaway attachment system to hold an areaway to a building as described in claim 38 and further comprising a low friction surface to which said free motion support is responsive.

56. An areaway attachment system to hold an areaway to a building as described in claim 38 wherein said free motion support comprises at least one flexible element.

57. An areaway attachment system to hold an areaway to a building as described in claim 38, 51, or 54 and further comprising a shield which protects said free motion support.

58. An areaway attachment system to hold an areaway to a building as described in claim 57 wherein said shield is integral to at least a portion of said free motion support.

59. An areaway attachment system to hold an areaway to a building as described in claim 57 wherein said shield is flexible.

60. An areaway attachment system to hold an areaway to a building as described in claim 57 wherein said shield is substantially waterproof.

61. An areaway attachment system to hold an areaway to a building as described in claim 58 wherein said shield is substantially waterproof.

62. An areaway attachment system to hold an areaway to a building as described in claim 38 wherein said free motion support comprises an integral mount.

63. An areaway attachment system to hold an areaway to a building as described in claim 38 wherein said continuously adjustable vertical element comprises a standard attachment for an areaway enclosure.

64. A method of establishing an areaway system for a building comprising the steps of:

a. locating a foundation opening on a building;

b. positioning an areaway enclosure adjacent said foundation opening;

c. providing for continuous movement of said areaway enclosure in relation to said foundation opening; and d. retaining said areaway enclosure around at least a portion of said foundation opening.

65. A method of establishing an areaway system for a building as described in claim 64 wherein said step of providing for continuous movement of said areaway enclosure comprises the step of allowing free movement of said areaway enclosure while accomplishing said step of retaining said areaway enclosure around at least a portion of said foundation opening.

66. A method of establishing an areaway system for a building as described in claim 65 and further comprising the step of restricting the movement of said areaway enclosure to only one degree of freedom.

67. A method of establishing an areaway system for a building as described in claim 65 or 66 wherein said step of allowing free movement of said areaway enclosure comprises the step of allowing said areaway enclosure to slide.

68. A method of establishing an areaway system for a building as described in claim 67 wherein said building has a foundation and further comprising the step of establishing a low fiction interface between said areaway enclosure and said foundation.

69. A method of establishing an areaway system for a building as described in claim 65 and further comprising the step of providing an escape element on said areaway enclosure.

70. A method of establishing an areaway system for a building as described in claim 65 wherein said step of retaining said areaway enclosure around at least a portion of said foundation opening is accomplished by at least two continuously movable attachments situated between said areaway enclosure and said building and further comprising the steps of:

a. selecting the desired orientation of said continuously movable attachments;

b. positioning said continuously movable attachments adjacent said foundation opening so as to achieve said desired orientation; and then c. accomplishing said step of retaining said areaway enclosure around at least a portion of said foundation opening.

71. A method of establishing an areaway system for a building as described in claim 70 wherein said is accomplished through continuously adjustable attachments and wherein said continuously adjustable attachments are removable and have axially opposite configurations.

72. A method of establishing an areaway system for a building as described in claim 65 and further comprising the step of limiting the movement possible when accomplishing the step of allowing free movement of said areaway enclosure.

73. A method of establishing an areaway system for a building as described in claim 72 wherein said step of limiting the movement possible comprises the step of restricting the downward motion of said areaway enclosure.

74. A method of establishing an areaway system for a building as described in claim 67 wherein said step of allowing said areaway enclosure to slide comprises the step of allowing flexure of an element of said areaway system.

75. A method of establishing an areaway system for a building as described in claim 65 or 66 wherein said step of allowing free movement of said areaway enclosure comprises the step of rotating an element in said areaway system.

76. A method of establishing an areaway system for a building as described in claim 65 or 66 wherein said step of allowing free movement of said areaway enclosure comprises the step of pivoting an element in said areaway system.

77. A method of establishing an areaway system for a building as described in claim 65 wherein said building has a foundation and further comprising the step of establishing a low fiction interface between said areaway enclosure and said foundation.

78. A method of establishing an areaway system for a building as described in claim 65 or 66 wherein said step of allowing free movement of said areaway enclosure comprises the step of allowing flexure of an element of said areaway system.

79. A method of establishing an areaway system for a building as described in claim 65 wherein said step of allowing free movement of said areaway enclosure is accomplished at at least one location and further comprising the step of shielding the location at which said step of allowing free movement of said areaway enclosure occurs.

80. A method of establishing an areaway system for a building as described in claim 67 wherein said step of allowing said areaway enclosure to slide is accomplished at at least one location and further comprising the step of shielding the location at which said step of allowing said areaway enclosure to slide occurs.

81. A method of establishing an areaway system for a building as described in claim 80 and further comprising the step of substantially waterproofing the location at which said step of allowing said areaway enclosure to slide is accomplished.

82. A method of establishing an areaway system for a building as described in claim 75, 76, or 77 wherein said step of allowing free movement of said areaway enclosure is accomplished at at least one location and further comprising the step of shielding the location at which said step of allowing free movement of said areaway enclosure occurs.

83. A method of establishing an areaway system for a building as described in claim 82 and further comprising the step of substantially waterproofing the location at which said step of allowing said areaway enclosure to slide is accomplished.

84. A method of establishing an areaway system for a building comprising the steps of:

a. detaching at least a portion of an areaway enclosure from a foundation face of a building;

b. establishing an ability for continuous movement of at least a portion of said areaway enclosure with respect to said foundation face;

c. replacing an areaway enclosure against said foundation face; and d. completely reattaching said areaway enclosure to said foundation face.

85. A method of establishing an areaway system for a building as described in claim 84 wherein said step of establishing an ability for continuous movement of at least a portion of said areaway enclosure with respect to said foundation face comprises the step of allowing free vertical movement of said areaway enclosure even after accomplishing said step of completely reattaching said areaway enclosure to said foundation face.

86. A method of establishing an areaway system for a building as described in claim 85 wherein said step of allowing free movement of said areaway enclosure comprises the step of providing for unrestricted vertical movement after accomplishing said step of completely reattaching said areaway enclosure to said foundation face.

87. A method of establishing an areaway system for a building as described in claim 84 wherein said step of establishing an ability for continuous movement of at least a portion of said areaway enclosure with respect to said foundation face comprises the step of installing a free motion support between said areaway enclosure and said foundation face.

88. A method of establishing an areaway system for a building as described in claim 87 wherein said step of installing a free motion support between said areaway enclosure and said foundation face comprises the step of attaching said free motion support to said areaway enclosure, and wherein said step of completely reattaching said areaway enclosure to said foundation face comprises the step of attaching said free motion support to said foundation face.

89. A method of establishing an areaway system for a building as described in claim 87 wherein said step of installing a free motion support between said areaway enclosure and said foundation face comprises the step of attaching said free motion support to said foundation face, and wherein said step of reattaching said areaway enclosure to said foundation face comprises the step of attaching said areaway enclosure to said free motion support attached to said foundation face.

90. A method of establishing an areaway system for a building as described in claim 87 wherein said step of installing a free motion support between said areaway enclosure and said foundation face comprises the steps off a. attaching a portion of said free motion support to said areaway enclosure; and b. attaching a portion of said free motion support to said foundation face; and wherein said step of completely reattaching said areaway enclosure to said foundation face comprises the step of sliding said portion of said free motion support attached to said areaway enclosure into said portion of said free motion support attached to said foundation face.

91. A method of establishing an areaway system for a building as described in claim 90 wherein said step of sliding said portion of said free motion support attached to said areaway enclosure into said portion of said free motion support attached to said foundation face comprises the step of sliding said portion of said free motion support attached to said areaway enclosure from above said portion of said free motion support attached to said foundation face.

92. A method of establishing an areaway system for a building as described in claim 87 wherein said areaway enclosure is situated adjacent ground and wherein said free motion support is responsive to motion of said ground.

93. A method of establishing an areaway system for a building as described in claim 87 wherein said free motion support permits unrestricted vertical movement of said areaway enclosure with respect to said foundation face.

94. A method of establishing an areaway system for a building as described in claim 84 and further comprising the step of restricting the movement of said areaway enclosure to only one degree of freedom.

95. A method of establishing an areaway system for a building as described in claim 86 wherein said step of providing for unrestricted vertical movement comprises the step of allowing said areaway enclosure to slide.

96. A method of establishing an areaway system for a building as described in claim 95 wherein said step of allowing said areaway enclosure to slide comprises the steps of:

a. establishing at least two guides to which said areaway enclosure is responsive; and b. establishing at least two tracks to which said guides are responsive.

97. A method of establishing an areaway system for a building as described in claim 85 and further comprising the step of limiting the movement possible when accomplishing the step of allowing free vertical movement of said areaway enclosure.

98. A method of establishing an areaway system for a building as described in claim 97 wherein said step of limiting the movement possible comprises the step of restricting the downward motion of said areaway enclosure.

99. A method of establishing an areaway system for a building as described in claim 86 wherein said step of providing for unrestricted vertical movement of said areaway enclosure comprises the step of rotating an element in said areaway system.

100. A method of establishing an areaway system for a building as described in claim 85 wherein said step of allowing free movement of said areaway enclosure comprises the step of pivoting an element in said areaway system.

101. A method of establishing an areaway system for a building as described in claim 85 and further comprising the step of creating a low friction interface between said areaway enclosure and said foundation face.

102. A method of establishing an areaway system for a building as described in claim 85 wherein said step of allowing free movement of said areaway enclosure comprises the step of allowing flexure of an element of said areaway system.

103. A method of establishing an areaway system for a building as described in claim 85 wherein said step of allowing free vertical movement of said areaway enclosure is accomplished at at least one location and further comprising the step of shielding the location at which said step of allowing free vertical movement of said areaway enclosure occurs.

* * * * *